US006502286B1

(12) United States Patent
Dubberke

(10) Patent No.: US 6,502,286 B1
(45) Date of Patent: Jan. 7, 2003

(54) DEVICE FOR IMMOBILIZING THE ENDS SHOE LACES

(76) Inventor: Markus Dubberke, Bergstrasse 8, D-73614 Schorndorf (DE)

( * ) Notice: Subject to any disclaimer, the term of this patent is extended or adjusted under 35 U.S.C. 154(b) by 0 days.

(21) Appl. No.: 09/647,542

(22) PCT Filed: Apr. 1, 1999

(86) PCT No.: PCT/EP99/02239

§ 371 (c)(1),
(2), (4) Date: Jan. 12, 2001

(87) PCT Pub. No.: WO99/49748

PCT Pub. Date: Oct. 7, 1999

(30) Foreign Application Priority Data

Apr. 1, 1998 (DE) ..... 19814672

(51) Int. Cl.[7] ..... A43B 11/00; A43C 7/00; F16G 11/00

(52) U.S. Cl. ..... 24/712.1; 24/712.5; 24/713.5; 24/713.6; 24/714.6; 36/50.1

(58) Field of Search ..... 24/712.1, 712.5, 24/713.5, 713.6, 714.6; 36/50.1

(56) References Cited

U.S. PATENT DOCUMENTS

| | | | | | |
|---|---|---|---|---|---|
| 1,962,964 | A | | 6/1934 | Morrison | |
| 3,122,805 | A | * | 3/1964 | Hakim | 24/712.1 |
| 3,345,707 | A | * | 10/1967 | Rita | 24/712.5 |
| 3,500,508 | A | * | 3/1970 | Bennett | 24/712.1 |
| 5,315,741 | A | * | 5/1994 | Dubberke | 24/712.1 |
| 5,325,613 | A | * | 7/1994 | Sussman | 36/50.1 |
| 5,477,593 | A | * | 12/1995 | Leick | 24/712.5 |
| 5,722,132 | A | * | 3/1998 | Jones | 24/712.1 |

FOREIGN PATENT DOCUMENTS

| | | | | |
|---|---|---|---|---|
| AU | 0271644 | * | 9/1964 | 24/712.1 |
| EP | 0693260 | | 1/1996 | |
| WO | WO93/18678 | | 9/1993 | |

* cited by examiner

*Primary Examiner*—Victor Sakran
(74) *Attorney, Agent, or Firm*—Burns, Doane, Swecker & Mathis, L.L.P.

(57) ABSTRACT

A device (1) for securing end portions (4) of ribbon (3), including a base (6), having at least two openings (17), a cap (5), including at least two openings (11), wherein cap (5) and base (6) are rotatable relative to one another wherein openings (17) cooperate with two openings (11) such that opposite ends (4) of ribbon (3) are guided through respective pairs of cooperating openings (11, 17), and ends (4) can be wound up, characterized in that in the spacing between first flat structure (12) and second flat structure (7) a separate hub element (23) includes teeth (14) staggered to be positioned on the gaps relative to one another, wherein teeth (14) form a v-shaped groove (25), which is interrupted by alternatingly staggered gaps and tapers toward the interior of the hub element (23).

33 Claims, 9 Drawing Sheets

Fig. 8b
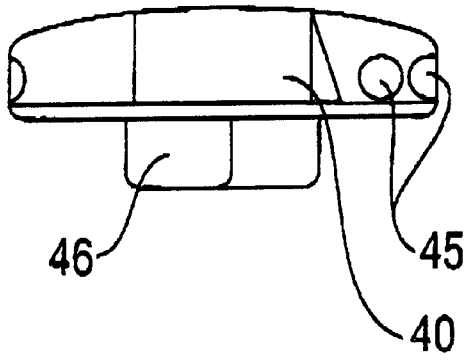
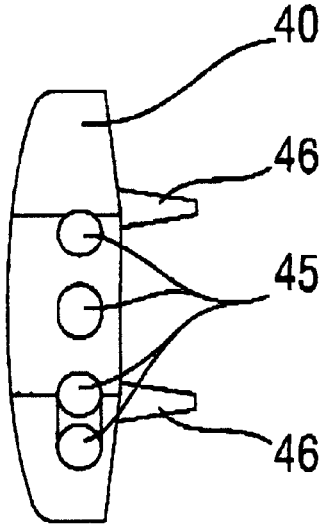
Fig. 8c
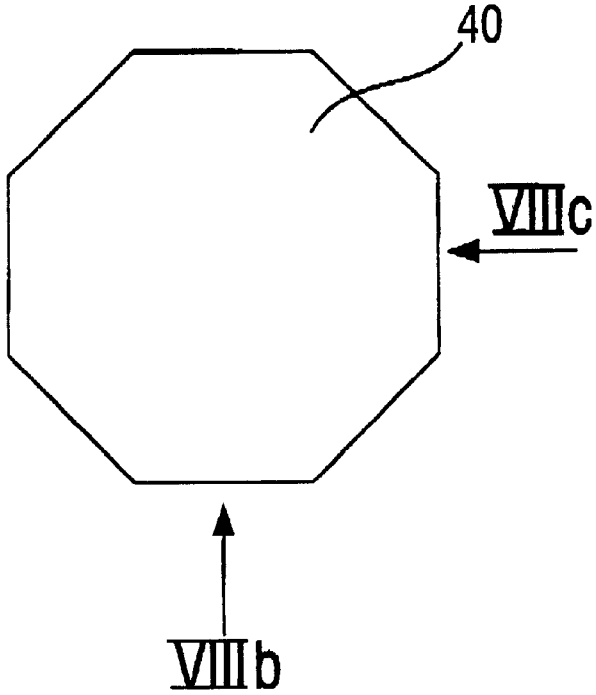
Fig. 8a

DEVICE FOR IMMOBILIZING THE ENDS SHOE LACES

TECHNICAL FIELD

The present application is a national stage filing under 35 U.S.C. § 371 of International Application PCT/EP99/02239 filed Apr. 1, 1999, which claims priority from German Patent Application 19814672.8, filed Apr. 1, 1998.

The present invention relates to a device FOR securing ribbons or laces, especially for securing end portions of at least one shoe lace.

PRIOR ART

Proposals for such devices are described in EP 0314628 A2, EP 0693260 A2, FR 1518038, DE 4209425 C1, and U.S. Pat. No. 3,500,508, U.S. Pat. No. 3,345,707, U.S. Pat. No. 948,071. The devices described in the aforementioned documents are especially designed for children of kindergarten age who have not yet learned to tie a shoe laces themselves and are designed to facilitate or eliminate the tying of the shoes.

For example, in DE4209425 C1 a press button for securing the shoe laces is described wherein a circular movement of an inwardly positioned ring effects that the shoe laces are clamped.

In particular, in EP 0693260 A2 a device for securing end portions of shoe laces is described wherein by rotation of a cap element relative to base element and/or by rotation of the base element relative to the cap element end portions or shoe laces can be wound onto a hub.

The known devices, however, have a series of disadvantages. Often, the known devices are comprised of relatively many individual parts, a fact which increases the production cost and may result in early wear of the devices. In particular, some of the known devices have spring means for securing the shoe laces so that upon weakening of the spring properties of the spring means the devices become inoperable. Furthermore, the known devices secure the shoe laces only in a relatively small area of the shoe laces with result that the fixation of the shoe laces is relatively weak and moreover, a large part of the shoe laces is accessible in an unprotected way. This causes problems, in particular, for high top shoes with correspondingly long shoe laces.

The device described in EP 0693260 A2 has the disadvantage that the shoe laces due to the continuous circumference of the hub cannot be precisely received and guided into the circumferential groove. A further disadvantage of the described device is the configuration of the hub which secured the shoe laces only unsatisfactorily, so that loosening of the shoe laces is possible. Due to the axial-symmetrical shape and the continuous circumferences of the hub and the circumferential groove, as unsatisfactory clamping at the shoe laces results because only a radially acting tension force but not a tangentially acting tension force, resulting mainly from the turning action, clamps the shoe laces in the groove.

Further disadvantages of the prior art relates to unsatisfactory storage capacities of the known devices for the end portions of the ribbons and laces to be secured. It is a disadvantage in this context that longer portions of, for example, shoe laces on high top shoes as well as clothing ribbons of jackets as well as their end portions, such as, for example, shoe lace tips, cannot be safely protected and stored in order to prevent soiling, wear, or the potential for an accident by getting caught or by tripping Further disadvantages of the prior art are the unsatisfactory protection of the device with regard to functional disturbances by soiling, for example, in the "outdoor" field, and, furthermore, are to be seen in that a slipping of the devices relative to the shoe or the piece of clothing cannot be prevented so that in most cases both hands are required for operating the devices.

The present invention has the object to provide an improved device for securing the shoe laces which avoids the disadvantages of the known devices.

DISCLOSURE OF THE INVENTION

The object of the invention is solved according to the invention by a device for securing ribbons, wherein a base element, comprising at least two openings spaced from its rotational axis in a first flat structure, as well as a cap element, comprising at least two openings in a second flat structure, which is provided at a spacing opposite the first flat structure, wherein the cap element said the base element are connected to one another such that the cap element is rotatable relative to the base element and in that, in at least one position of the cap element relative to the base element, two openings of the base element cooperate with two further openings of the cap element such that an end portion of a ribbon can be guided through a pair of cooperating openings and another said portion of the same ribbon or of another ribbon can be guided through another pair of cooperating openings, and the end portions can be wound up upon rotation of the cap element relative to the base element and/or by rotation of the base element relative to the cap element. The device for securing ribbons, especially shoe laces, is characterized according to the invention by the following features:

- in the spacing between first and second flat structures, a hub element is arranged which is axial-symmetrical and non-rotatable and comprises teeth which are arranged staggered to be positioned in gaps which have a V-shaped groove interrupted alternatingly and staggered and tapers toward the interior of the hub element for receiving windings;
- the first flat structure comprises at least two openings spaced from the hub element;
- the end portions can be wound onto the hub element by rotation of the cap element relative to the base element and the hub element and/or by a rotation of the base element of the hub element relative to the cap element.

The winding of the end potions of the ribbon makes it possible to provide a safe and uncomplicated securing of the end portions of the ribbons which are thus protected substantially against wear by bending, shearing, or tearing. The device according to the invention makes it possible to wind the end portions of the ribbon onto the hub element, for example, by a simple rotation of the cap element relative to the base element, so that further individual parts, especially spring means, can be dispensed with. This makes it possible to provide a simple and wear-protected manipulation at the device according to the invention.

An especially safe and fast receiving and securing of the ribbons is provided by the hub element according to the invention. The hub element is embodied separately as an individual parts and can thus be produced especially simply. This hub element, by means of the teeth staggered to be positioned in gaps, has a non-continues edge which, upon rotation of be cap element relative to the base element, performs a resulting wave movement which guides the ribbon into the groove which tapers toward the interior of the hub element for receiving the ribbon windings. The novel securing action of the ribbons is realized by the hub element according to the invention comprising staggered teeth which guide the ribbon during the first rotations of the cap element relative to the base element into V-shaped, alternatingly interrupted groove, which is formed by the teeth, staggered to be positioned in gaps, and tapers in the direction toward the interior of the hub element, for receiving ribbon windings wherein the ribbon is clamped especially tightly and safely in the groove because of the staggered arrangement of the teeth. The ribbon secures itself according to the invention not only during the first half rotation by clamping in the innermost area of the tapering groove but also during the further rotations the ribbon is clamped effectively between the teeth which, according to the invention, are staggered and arranged perpendicularly to the acting tension force. A sufficient securing of the ribbon or the ribbons is thus achieved already upon the first rotations of the cap element relative to the base element, without the ribbons arrested such having to be secured by a further winding up or winding about by means of further ribbon windings. Thus, an especially cafe securing action results especially also for very short ribbons.

It is advantageous that in the interior of the device between the cap element and the base element and about the hub element an annular hollow space is formed in which the end portions of one or more ribbons can be wound in a crossed fashion by rotation of the cap element relative to the base element and/or by rotation of the base element relative to the cap element.

It is preferred when two openings are provided in the first flat structure of the base element and in the second flat structure of the cap element, respectively, wherein two openings in the first flat structure of the base element and in the cap element are diametrically oppositely arranged relative to the element.

It is especially preferred when the openings have a spacing as large as possible from the peg and are thus arranged preferably at the outer of end of the first and second flat structure.

In a preferred embodiment of the device according to the invention, the base element has an rim portion and/or the cap element has an rim portion such that the base element and the cap element contact one another and form a closed unit of cap element and base element. Accordingly, the end portions of the ribbons are protected against soiling and the effects of the surroundings so that a greater safety during use (for example, running through bushes or underbrush) of the device according to the invention will result.

It as furthermore preferred when the cap element is detachably connected to the base element. In an especially preferred further embodiment of the device according to the invention, the base element has a peg, projecting axial-symmetrically from the first flat structure and comprising a bore, and the cap element has a pin wherein the pin can be inserted into the bore of the peg and the cap element is connected by means of a securing ring with the base element its a rotatable fashion.

It is preferred when the peg has a polygonal cross-section and the hub element has a precisely fitting bore which makes it possible to place the hub element axial-symmetrically and non-rotatably onto the peg.

Especially preferred is when the peg has a square cross-section and the hub element has a precisely fitting matching square bore which makes it possible to place the hub element axial-symmetrically and non-rotatable onto the pin wherein the square cross-section prevents a rotation of the hub element relative to the base element even at high torque as results upon forceful and sudden rotation.

It is finally advantageous when the staggered teeth form two tooth rings which are staggered so as to be positioned in gaps relative to one another, in order to provide an equally suitable receiving and securing action of the ribbons independent of the position of the hub element.

It is especially expedient when the teeth have an average slant angle of greater than 35° because, in this way, an especially good guiding action of the ribbons in the tapering groove and an especially secure clamping of the ribbons between the staggered teeth can be achieved. Moreover, it is advantageous when the outwardly oriented tooth flanks have a slant angle of 90° because, in this way, the hub element is planar at its underside and overall very flat, and this results in an especially compact configuration of the entire device.

It is especially advantageous when the tooth rings rotated to be staggered relative to the gaps each have 4 teeth so that, on the one hand, there are so many teeth that, independent of the position of the hub element, a receiving and securing action of the ribbons directly during the initial rotation of the cap element relative to the base element can take place, and, on the other hand, with only 4 teeth each, the individual teeth can be designed such that an especially advantageous depth and especially wave-shaped group for receiving of especially long areas of ribbons, especially of shoe laces in the case of shoes with many eyelets, and for a particularly fixed securing action of ribbons.

Finally, it is advantageous when two teeth each of the tooth rings are positioned perpendicularly to one another and one tooth of a tooth ring extends parallel to a tooth of the other tooth ring, respectively, and is displaced parallel to it by a width of a gap because by means of the parallel arrangement of two teeth, respectively, an especially wave-shaped and acute angle-shaped groove results which makes possible an especially fixed securing of the ribbons not only in the interior of the groove and, by means of the gap width between the parallel arranged teeth, the ribbons are simultaneously protected significantly against wear by extreme bending or shearing.

It is especially expedient that the underside of the hub element when it is placed onto the peg, is completely contacted with the first flat structure because, in this way, the ribbon cannot accidentally enter between the first flat structure and the hub element.

It is especially advantageous that the hub element has a height so that it projects past the rim portion of the base element and into the axial-symmetrical annular depression in the second flat structure because, in this way, the ribbon cannot enter accidentally between the second flat structure and the hub element without the hub element contacting the second flat structure over a large surface area and, in this way, an undesirable friction between the hub element and the second flat structure upon rotation of the cap element relative the base element is not possible.

The cap element comprises on its rim portion preferably a profile in order to facilitate rotation of the cap element.

For a simpler manipulation of the device according to the invention and for an especially advantageous facilitating of the rotation of the cap element an outer profiled grip-enhancing and ergonomically shaped ring element is placed so as to be non-rotatable on the rim portion of the cap element.

It is expedient when the cap element and the base element have markings for facilitating the guiding through of the end portion of at least one ribbon or shoe lace through the pairs of cooperating openings of the base element of the cap element.

It is moreover advantageous when the rim portion of the base element on its outer side has a sealing ring wherein the sealing ring is in contact with the rim portion of the cap element. This provides a sealed unit of cap element and base element so that the penetration of dirt or dust into the device and especially between gliding surfaces is prevented and a functional blockage is prevented.

It is especially advantageous in this context when the sealing ring is arranged in a circumferential groove at the outer side of the rim portion of the base element in order to prevent slipping of the sealing ring.

Advantageous materials for the sealing ring are, for example, rubber, foamed rubber-like plastic or felt.

A preferred device according to the invention has knobs at the outer side of the first flat structure of the base element which prevent slipping of the base element relative to a shoe or piece of clothing. Especially preferred in this connection is a device which at the outer side of the first flat structure of the base element has a bead-shaped, outwardly overlapping ring element wherein the ring element has a recess is the area of the openings. Especially preferred is a device wherein the ring element is comprised of soft material which cannot slip on textile materials. Such a ring element improves adhesion and adaptation of the device especially on textiles pieces of clothing and makes a single-handed operation of the devise easier.

A further improvement of the device invention resides in that the hub element at the underside has pin-shaped projections and that the first flat structure of the base element has corresponding recesses matching the pin-shaped projections. The pin-shape projections engage the recesses and connect the hub element in an immobile manner on the base element. When the hub element additionally has a bore of radial symmetry and is arranged in a precisely fitting way on a peg of radial symmetry projecting from the first flat structure for a securing action, one peg-shaped recess and one corresponding recess are sufficient.

The size reduction of the hub element and especially excellent clamping properties are provided by a hub element in which the flanks of the tooth forming the tapering groove are circular-arc shaped and the circular arc radius increases continuously toward the interior of the groove. This results in a greater hollow space in the interior of the devise and makes it possible, for the same outer dimensions of the device, to receive more ribbon volume in the device, which, for example can be used advantageously when applied in connection with children's shoes in order to provide a correspondingly smaller device with the same shoe lace capacity.

A further improvement of the device resides in that the devise has a lid element with channels for receiving ends or tips of ribbons, wherein the lid element with the penetrating channels receives the ribbon portions projecting from the openings. This is especially advantageous because the and portions or tips of the ribbon projected unprotectedly from the openings of the device and are thus exposed to dirt, wetness, and wear and presented an injury risk by tripping of getting caught. The ends or the tips of the ribbons in the lid element are protected from external influences and are safely packaged and stored.

In this connection it is advantageous when the underside of the lid element is in areal contact with the outer side of the second flat structure and does not cover the openings in this arrangement. This makes possible an especially compact construction of the device.

In a preferred device, the lid element has, additionally pins which engage corresponding recesses in the outer side of the second flat structure and thus prevent rotation and slipping of the lid element relative to the cap element. By this, the lid element is additionally secured on the cap element.

In an especially preferred device on the outer side of the cap element a rim element is securely fastened wherein the rim element has as axial-symmetrical recess at the outer side Of the second flat structure for receiving in a precisely fitting way the lid element and a substantially continuous transition the outer surface of the rim element and the lid element results. Accordingly, the components cap element, rim element, and lid element of the device provide an optical and technical unit to the exterior. Moreover, the shoe laces in this way are especially safely packaged in the lid element and the risk of injury is substantially excluded.

It is especially preferred when the rim element is comprised of soft materials such as, for example, a soft plastic in order to achieve good gripping and handling of the device,

BRIEF DESCRIPTION OF THE DRAWINGS

The attached drawings and following description serve to further explain the invention. It is shown in:

FIG. 8*a* the lid element 40 of the preferred second embodiment of the invention;

FIG. 8*b* the lid element 40 viewed in the direction VIIIb of FIG. 8*a;*

FIG. 8*c* the lid element 40 viewed in the direction VIIIc on FIG. 8*a;*

EMBODIMENT

Figure 1:
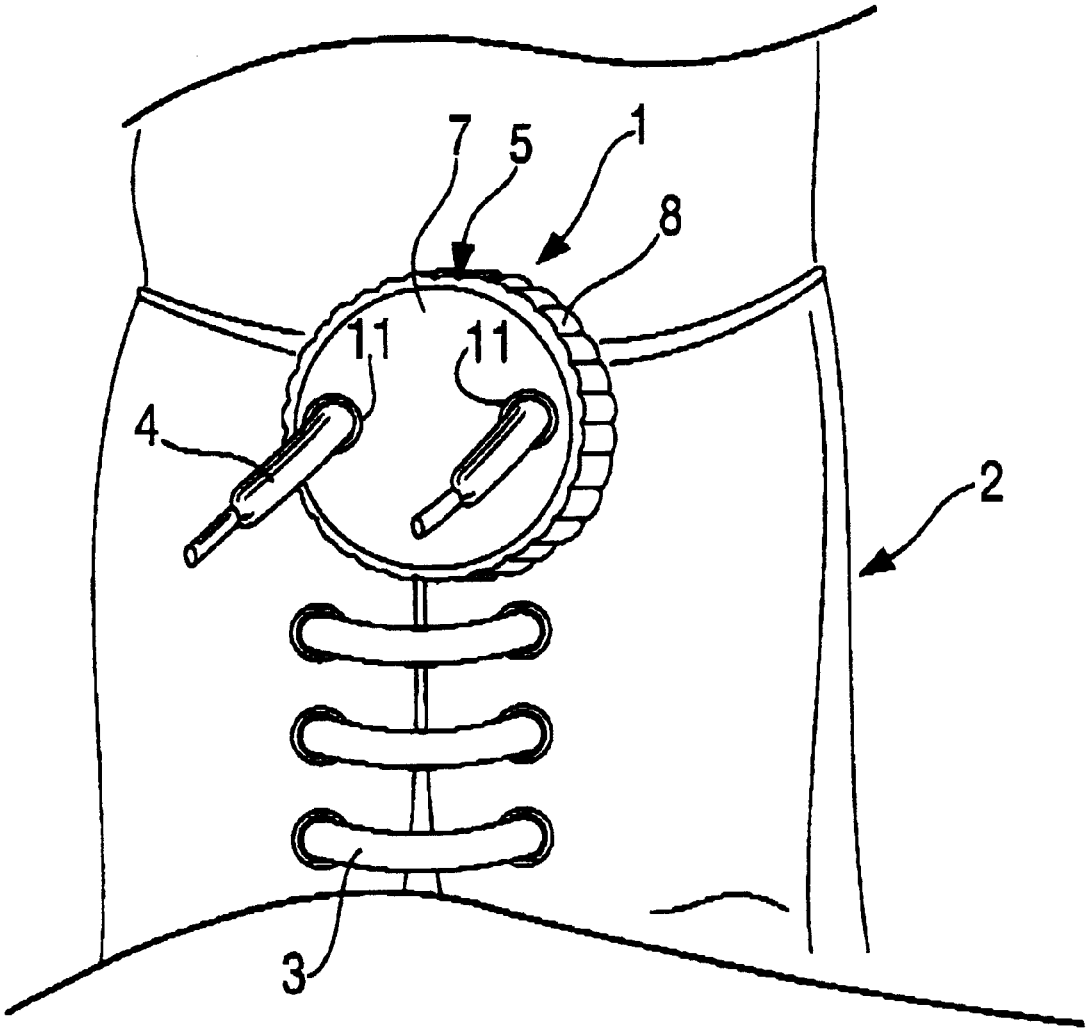
FIG. 1 an inventive device of well as a possible arrangement of the device on a high top shoe.

FIG. 1 shows a device 1 according to the invention and its possible arrangement on a high top shoe 2. The high top shoe 2 is fastened on the foot or leg of the wearer by shoe laces 3. For securing the ends 4 of the shoe laces, the device 1 according to the invention is provided.

Figure 2:
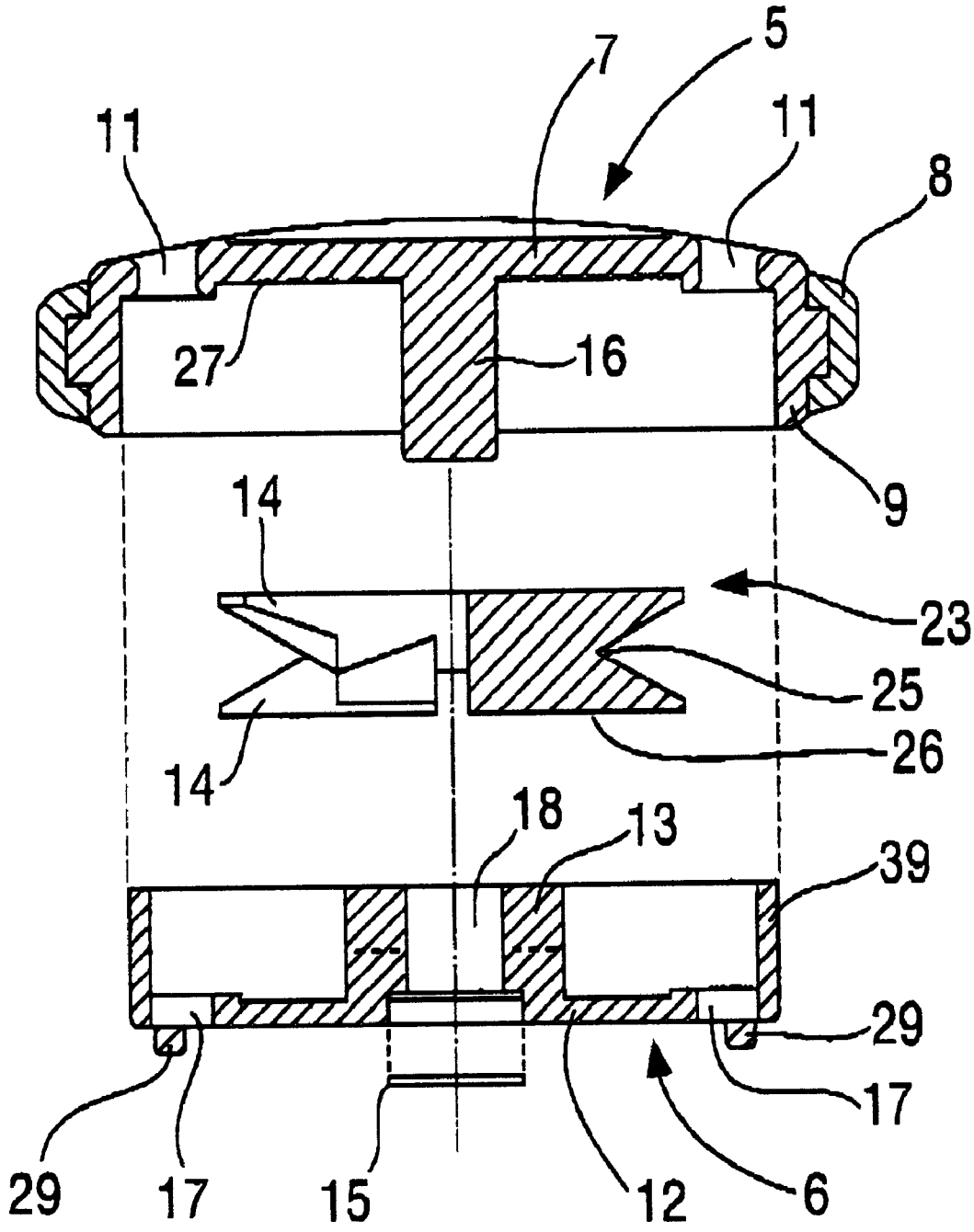
FIG. 2 a section of the individual components of a preferred first embodiment of the invention.
Figure 3B:
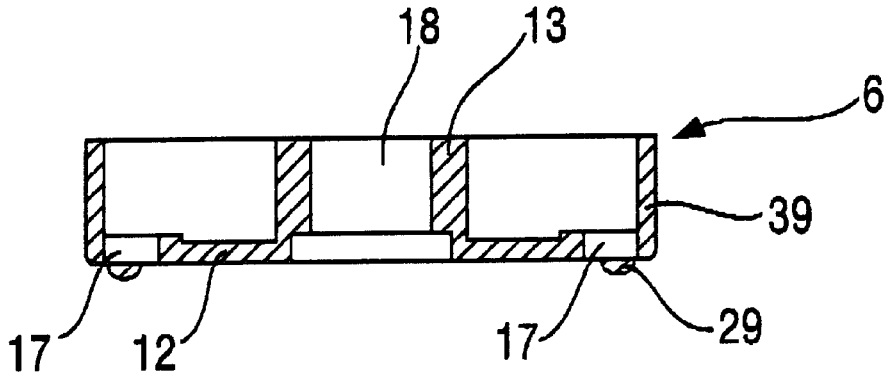
FIG. 3*b* a section along the line IIIb—IIIb of FIG. 3*a* through the base element 6.
Figure 3A:
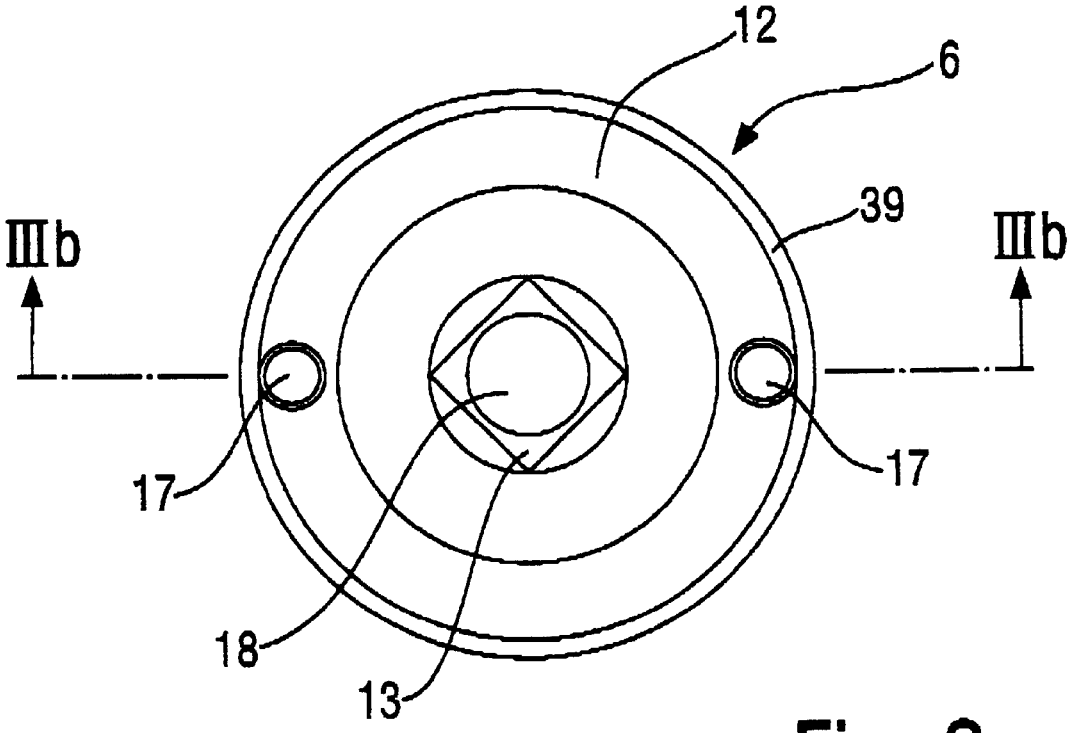
FIG. 3*a* the base element 6 of the preferred first embodiment.

FIG. 2 shows a section of a first embodiment of the device 1 according to the invention, comprising the cap element 5, the base element 6, and hub element 23. The base element 6 comprises a first flat structure 12 with a peg 13 projecting from the first flat structure and at least two openings 17 in the first flat structure spaced from the hub (FIGS. 2, 3*a*, and 3*b*). The cap element 5 comprises a second flat structure 7 and at least two spaced apart openings 11 (FIGS. 1, 2, 4*a* and 4*b*) which are arranged in the second flat structure 7 such that by at least one position of the cap element 5 relative to the base element 6 two openings in the first flat structure of the base element are aligned with two openings 11 in the second flat structure 7 of the cap element 6. The hub element 23 it axially symmetrical and non-rotatably connected to the peg 13 of the base element and the cap element is rotatable connected with base element 6 by means of the securing ring 15, wherein the second flat structure of the cap element and the first flat structure of the base element are positioned opposite one another and the hub element 23 is surrounded by them. Moreover, the cap element 5 has a rim portion 9 which surrounds the rim portion 39 of the base element 6 so that the device 1 forms a closed unit. The rim portion 9 is provided on its outer side with a profile 10 onto which is placed in a precisely fitting way a ring element 8 so as to be non-rotatable. The ring element 8 is provided with a profiled, grip-enhancing, and ergonomically shaped surface and facilitates thus a rotation of the cap element 5 relative to the base element 6.

In the application of the device 3 according to the invention, for example, on a shoe it is only necessary to align two openings 11 in the second flat structure 7 of the cap element 5 with the openings in the first flat structure of the base element (FIGS. 2 and 3). For this a marking on the cap element 5 and a marking on the base element 6 are provided. When the two markings coincide, one shoe lace and 4 can be guided through the oppositely arranged aligned openings 11, 17, respectively. The device 1 according to the invention is then pressed along the two ends 4 of the shoe laces against the shoe 2 (FIG. 1 ). By a simple rotation of the cap elements 5 relative to the base element 6, the end portions 4 of shoe lace 3 are wound onto the hub element (FIGS. 2, 5*a*, 5*b*) of the base element 6. When doing so the end portion 4 of the shoe lace 3 are pulled into the device 1 according to the invention through the oppositely arranged aligned openings. The short remaining portions of the ends 4 of the shoe laces projecting from the openings 11 of the cap element 5 can then be tied in a knot or can be provided with universal tips (FIG. 1).

FIGS. 3*a* and 3*b* show the base element 6 of the first embodiment. The base element comprises a first flat structure 12, a rim portion 39 arranged on the outer edge of the first flat structure, an axial-symmetrically arranged peg 13 which is square in cross-section, having an axial-symmetrically bore 18 and two openings 17 which, with respect to the peg, are positioned diametrically and with identical spacing from the peg. The bore 18 has an axial-symmetrical widened portion 28 in which the securing ring 15 is inserted and connected with the pin 16 (FIGS. 2 and 4*a*) of the cap element during assembly of the device, for example, by gluing or riveting. The first flat structure comprises knobs 29 at the outer side facing the shoe which prevent a rotation of the base element relative to the shoe. The fist flat structure comprises at its inner side an axial-symmetrical depression 30 which matches the peg 13 a precisely fitting way so that the end lace of the inner flanks of the teeth 14 are flush with the first flat structure and the shoe laces cannot become caught between the first flat structure and the hub element 23 and/or cannot become caught on the teeth 14 (FIG. 2).

Figure 4B:
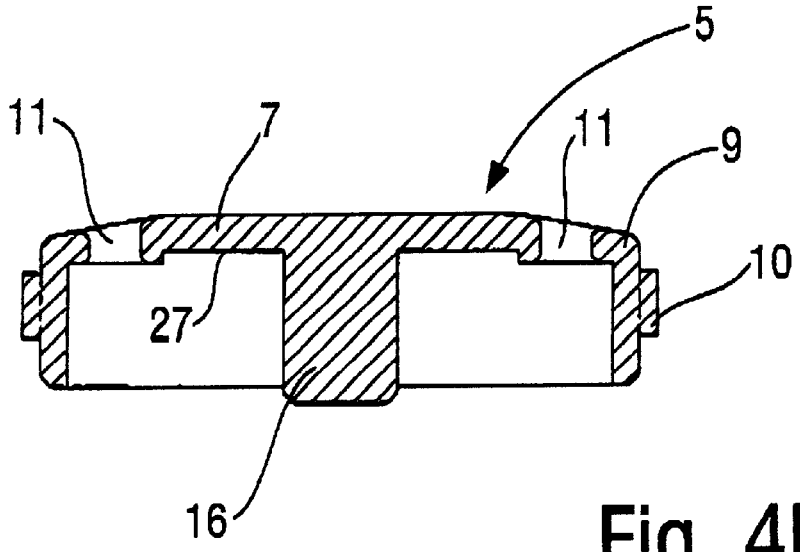
FIG. 4*b* a section along the line IVb—IVb of FIG. 4*a* of the cap element 5, FIG. 5*a* the hub element 23 of the preferred first embodiment FIG. 5*b* the hub element 23 viewed in the direction Vb of FIG. 5*a;*
Figure 4A:
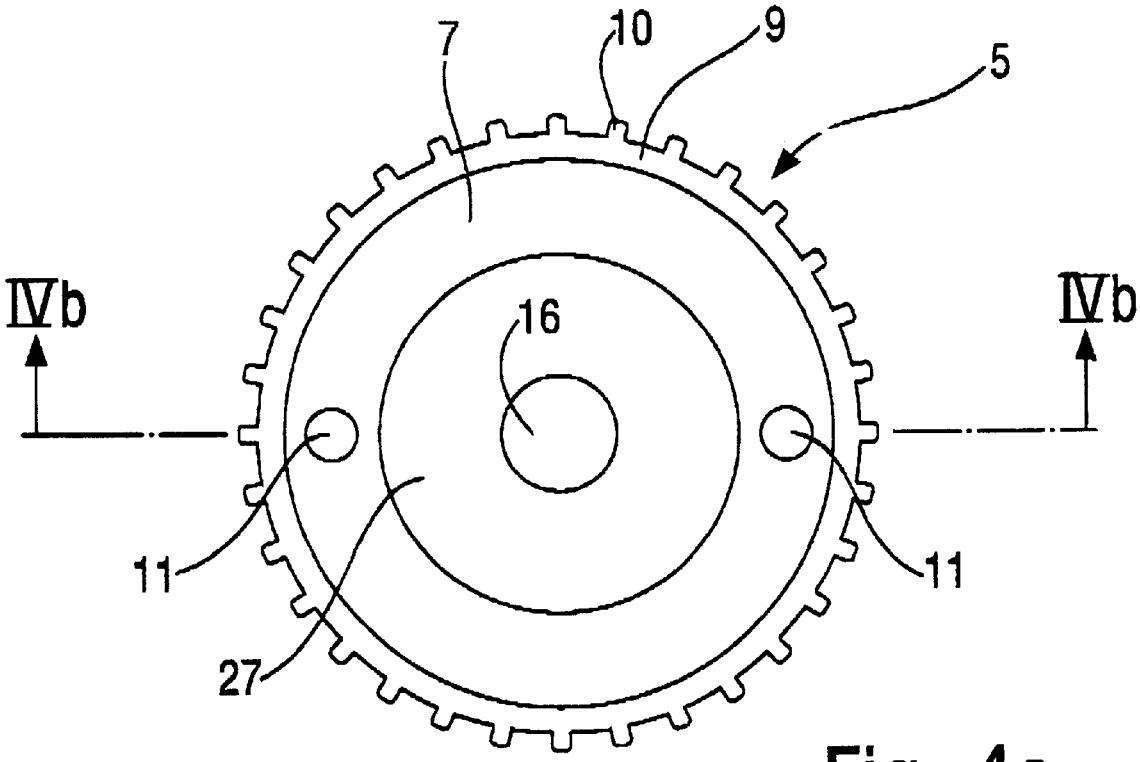
FIG. 4*a* the cap element 5 of the preferred first embodiment.

FIGS. 4*a* said 4*b* show the cap element 5 of the first embodiment. The cap element 5 comprises a second flat structure 7, a rim portion 39 arranged on the outer edge of the second flat structure, an axial-symmetrical pin 16 and two openings 11 which, with respect to the pin, are positioned diametrically opposite and spaced at identical spacing from the pin. The second first structure comprises at its inner side around the pin 16 an axial-symmetrical depression 27 which matches in a precisely fitting way the hub element so that the hub element 23 can be inserted into the axial-symmetrical, ring-shaped depression 27 and thereby the shoe lace cannot enter in an undesirable fashion between the second flat structure and the hub element without in this connection the hub element contacting the second flat structure over a large surface area to that thereby no undesirable friction between the hub element 23 the second flat structure 7 results upon rotation of the cap element relative to the base element, the cap element moreover comprises on the outer side of the rim portion a profile 10 for facilitating rotation of the cap element and/or for securing a ring element (FIGS. 6*a* and 6*b*) placed onto the rim portion of the cap element.

Figure 5B:
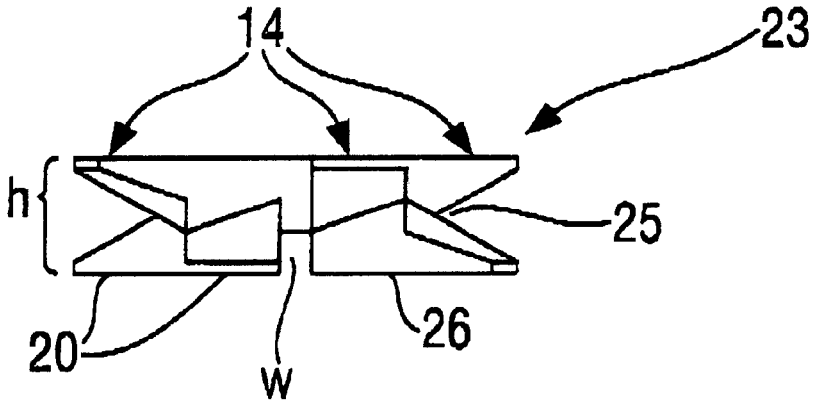
Figure 5A:
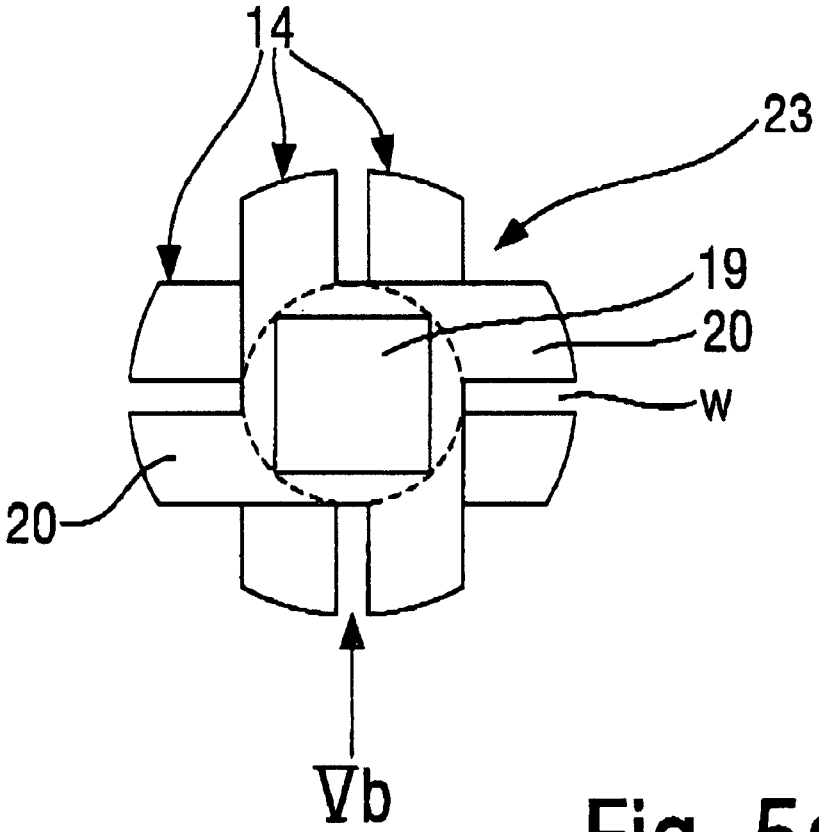

FIG. 5*a* and 5*b* show the hub element 23 of the first embodiment. The hub element has teeth 14 which are staggered, a V-shaped groove 25, which is interrupted at the sides by staggered gaps and tapers toward the interior of the hub element 23, and a square bore 19. The teeth 14 are arranged staggered to one another and form two toothed rings in which are rotated relative to one another to be staggered relative to the gaps. The teeth have an average slant angle of greater 33° wherein the outwardly directed tooth flanks 20 have a slant angle of 90° so that the underside 26 and the side oppositely positioned thereto each form a plane surface and are spaced from one another by the height h. The two tooth rings, which are rotated and staggered to be positioned in the gaps, each have 4 teeth, wherein two teeth of a tooth ring are positioned perpendicularly to one another and one tooth of a tooth gear is arranged parallel to one tooth of the respective other tooth ring and displaced parallel thereto by a gap width w relative to it.

Figure 6B:
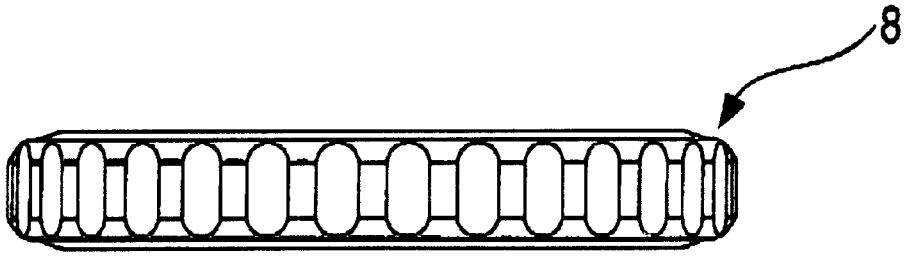
FIG. 6*b* the ring element 8 viewed in the direction VIb of FIG. 6*a;*
Figure 6A:
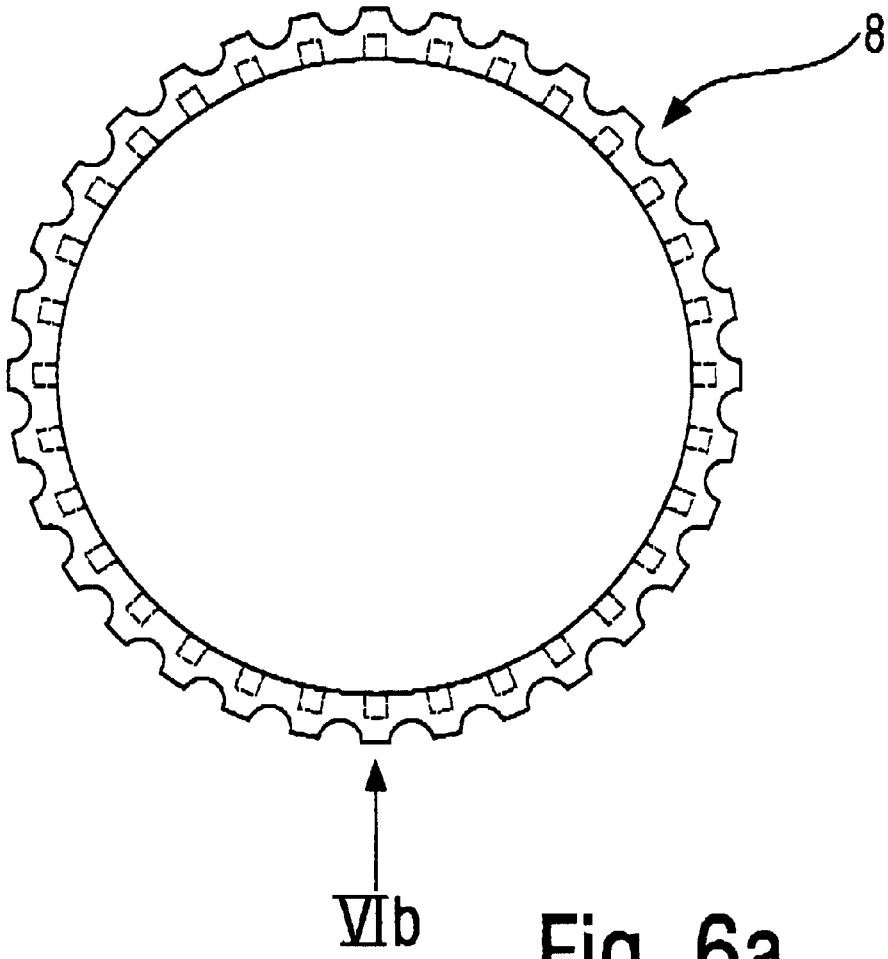
FIG. 6*a* the ring element 8 of the preferred first embodiment.

FIGS. 6*a* and 6*b* show the ring element 8 of the first embodiment. The ring element has at its outer side a profiled, grip-enhancing and ergonomically shaped surface 31 and at the inner side depressions 32, the depressions match with a precise fit the profile 10 (see FIGS. 1*a* and 4*b*) of the cap element and allow thus a non-rotatable placement of the ring element onto the cap element (see FIG. 2).

Figure 7:
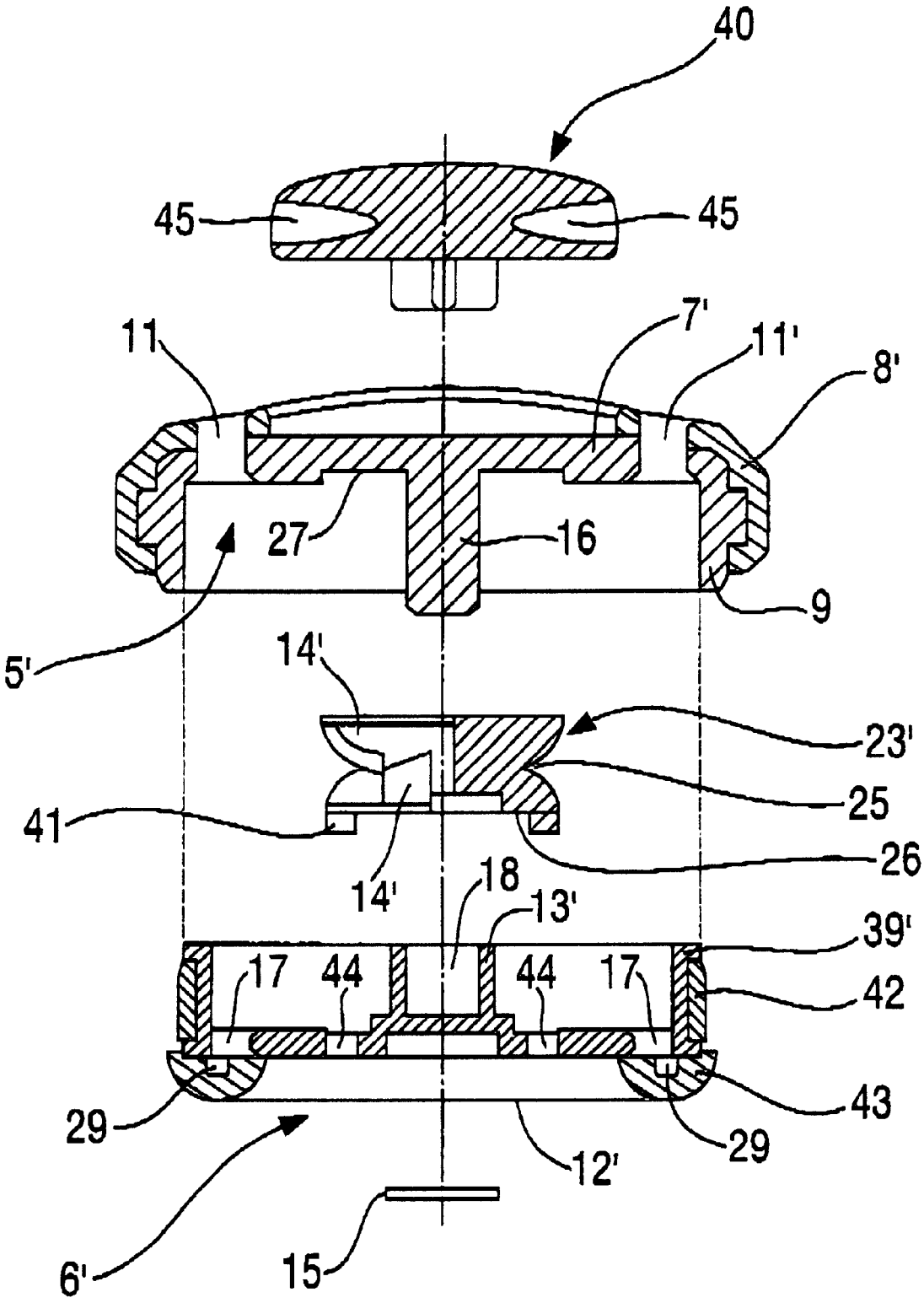
FIG. 7 a section of the individual components of a preferred second embodiment of the invention.

FIG. 7 shows a section of a second embodiment of the device 1 according to the invention, comprising the cap element 5', the base element 6' and the hub element 23'. The base element 6'comprises a first flat structure 12' with a peg 13' projecting from the first flat structure and, at least two openings 17 spaced from the hub in the first flat structure. The cap element 5' comprises a second flat structure 7' and two spaced apart openings 11 which are provided is the second flat structure 7 such that at least in one position of the cap element 5' relative to the base element 6' two openings in the first flat structure of the base element are aligned with two openings 11 in the second flat structure 7' of the cap element 6'. The hub element 23' in axially symmetrically placed onto the peg 13 of the base element and the cap element 5' is rotationally secured on the base element 6' by the securing ring 15, wherein the first flat structure 7' of the cap element 5' and the first flat structure 12' of the base element 6' are positioned opposite to one another and surround the hub element 23'. The hub element 23' comprises at its underside 26' peg-shaped projections 41 which engage corresponding recesses in the first flat structure 12' and prevent a rotation of the hub element 23' relative to the base element 6'. Moreover, the hub element 23' has a tapering groove 25' which it formed by the flanks of the teeth 14'. The flanks of the teeth 14' have a circular arc shape wherein the circular arc radius increases continuously toward the interior of the groove.

The cap element 5' comprises moreover a rim portion 9 which surrounds the rim portion 39' of the base element 6' such that the device forms a closed unit.

The rim portion 39' has on outer circumferential groove in which a sealing ring 42 of a foamed plastic material is arranged which is in contact with the rim portion 9 and provides a dust-tight connection between the base element and the cap element.

At the outer side of the element 5' a rim element 8' is arranged securely. The rim element 8' is provided with a profiled, grip-enhancing and ergonomically shaped surface and facilitates thus a rotation of the cap element 5' relative to the base element 6'. Moreover, the rim element 8' has an axial-symmetrically arranged recess an the outer side of the second flat structure 7' for receiving in a precisely fitting way the lid element 40. With the lid element 40 being placed thereon, as almost continuous transition between the outer surfaces of the rim element 8' and the lid element 40 in provided.

The first flat structure 12, 12' of the base element 6, 6' has at its outer side knobs 29 which prevent a slipping of the base element 6, 6' relative to the shoe 2 or the piece of clothing. In addition, a bead-shaped, outwardly overlapping ring element 43 is provided on the base element 6', wherein the ring element (43) has a recess in the force, of the openings 17. The ring element 43 is comprised of soft material that does not slip on textiles and adapts to its base.

The FIGS. 8*a*, 8*b*, and 8*c* show the lid element 40. Pegs 46 at the underside of the lid element 40 engage in the mounted state corresponding recesses (not shown) in the second flat structure 7' and prevent thus a rotation of the lid element 40 relative to the cap element 5'. The lid element is moreover penetrated by channels 45.

Figure 9A:
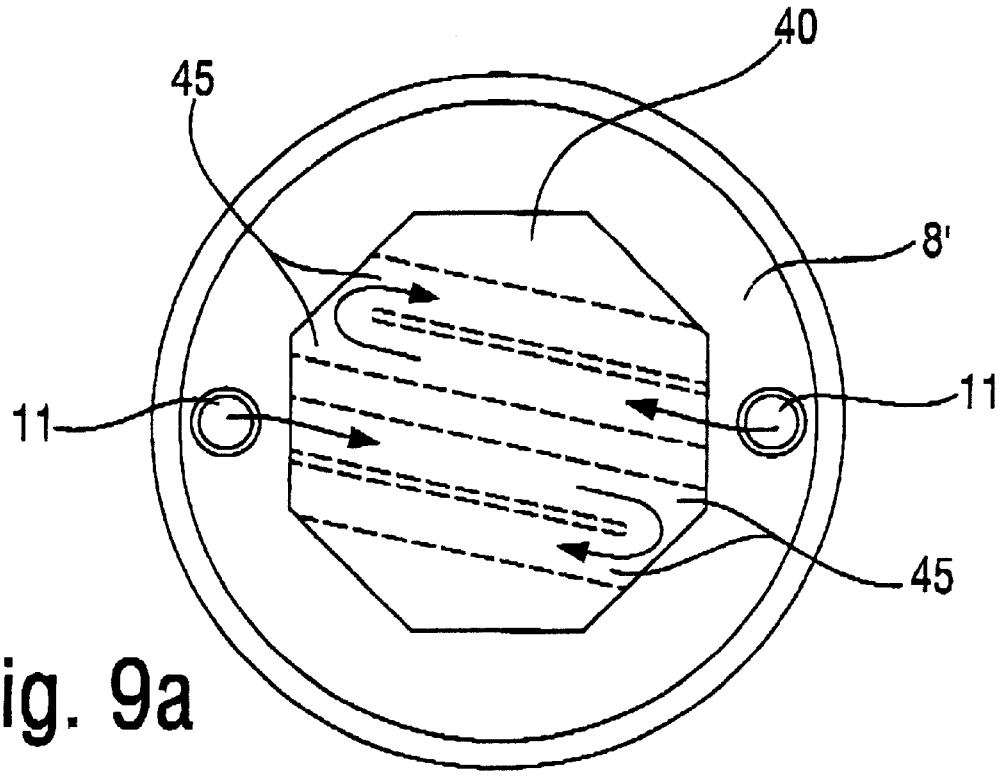
FIG. 9*a* a plan view onto the second embodiment of the invention, with arrows indicating a possible threading direction of the ribbon ends 47.
Figure 9B:
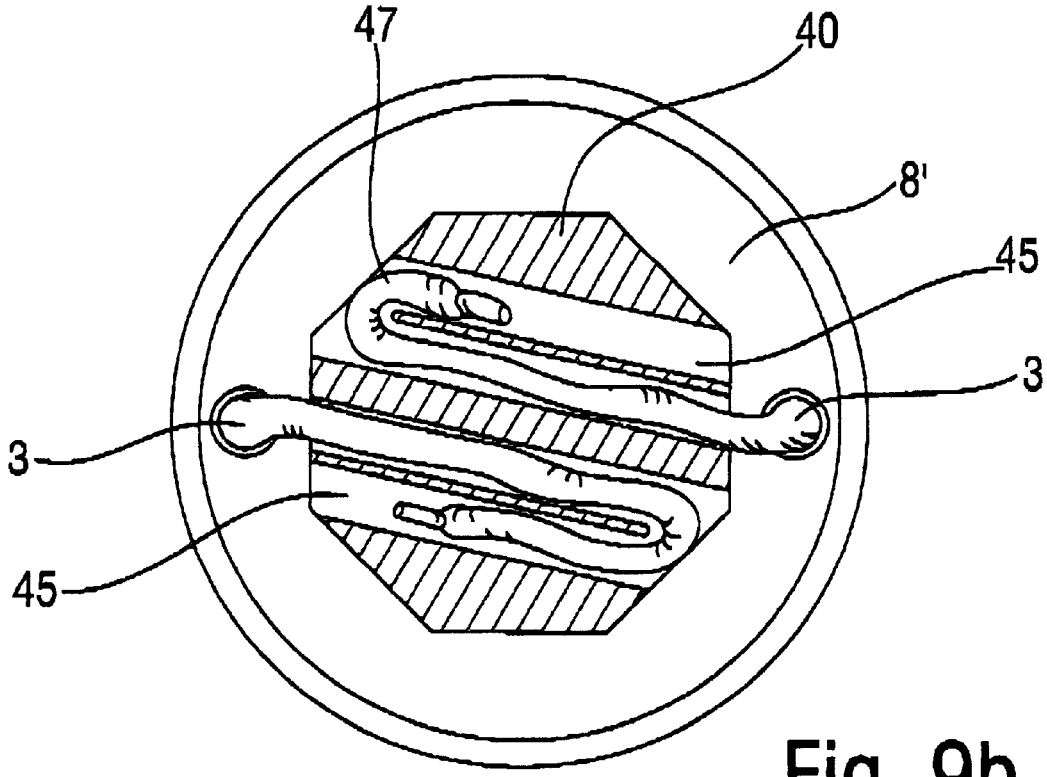
FIG. 9*b* a plan view onto the second embodiment of the invention, with lid element 40 shown in section and with threaded ribbon ends 47.

The FIGS. 9*a* and 9*b* show plan views onto the second embodiment of the device according to the invention. The lid element 40 is axial-symmetrically arranged relative to the cap element 5' in the recess of the rim element 8' wherein the openings 11 are not covered. The channels 45 of the lid element 40 have received the ends 47 of the ribbons which are the therefore packaged.

The function of the second embodiment corresponds initially to the first embodiment of the device according to the invention. In addition, the ends of the ribbons are inserted as far as possibly into the channels 45 of the lid element and the lid element is placed onto the cap element 5' by insertion into a precisely fitting recess of the rim element 8'.

What is claimed is:

1. A device (1) for securing end portions (4) of at least one ribbon (3), comprising a base element (6, 6'), comprising at least two openings (17) spaced from its rotational axis in a first flat structure (12, 12'), as well as a cap element (5, 5'), comprising at least two openings (11) in a second flat structure (7), which is positioned at a spacing from the first flat structure (12, 12'), wherein the cap element (5, 5') and the base element (6, 6') are connected to one another so that the cap element (5, 5') is rotatable relative to the base element (6, 6') and in at least one position of the cap element (5, 5') relative to the base element (6, 6') two openings (17) of the base element (6, 6') cooperated with two further openings (11) of the cap element (5, 5') such that an end portion (4) of one ribbon (3) is guided through a pair of cooperating openings (11, 17) and another end portion (4) of the same ribbon (3) can be guided through another pair of cooperating openings (11, 17), and the end portions (4) can be wound up by rotation of the cap element (5, 5') relative to the base element (6, 6'), characterized in that in the spacing between the first flat structure (12, 12') and the second flat structure (7) a separate hub element (23, 23') that is axial-symmetrical and non-rotatable and comprises teeth (14, 14') positioned staggered relative to one another, wherein the teeth (14, 14') form a v-shaped groove (25, 25'), which is interrupted by alternatingly staggered gaps and tapers toward the interior of the hub element (23, 23'), for receiving ribbon windings, and that the first flat structure (12, 12') comprises at least two openings (17) spaced from the hub element (23, 23'), and the end portions (4) can be wound onto the hub element (23, 23') by a rotation of the cap element (5, 5') relative to the base element (6, 6') and the hub element (23, 23').

2. The device (1) according to claim 1, characterized in that in the interior of the device, between the cap element (5, 5') and the base element (6, 6') and about the hub element (23, 23') an annular hollow space is formed, wherein the end portions (4) can be wound in a crossed fashion onto the hub element (23, 23') in the hollow space by a rotation of the cap element (5, 5') relative to the base element (6, 6') and the hub element (23, 23').

3. The device (1) according to claim 1, characterized in that two openings (11, 17) are respectively provided in the first flat structure (12, 12') of the base element (6, 6') and in the second flat structure (7) of the cap element (5, 5').

4. The device (1) according to claim 3, characterized in that two openings (11, 17) are positioned diametrically opposed to one another relative to the hub element (23, 23') in the first flat structure (12, 12') of the base element (6, 6') and in the second flat structure (7) of the cap element (5, 5'), respectively.

5. The device (1) according to claim 3 characterized in that the openings (11, 17) are arranged on the outer end of the first flat structure (12, 12') and the second flat structure (7), respectively.

6. The device (1) according to claim 1, characterized in that the base element (6, 6') has a rim portion (39, 39') and/or the cap element (5, 5') has a rim portion (9) such that the base element (6, 6') and the cap element (5, 5') contact one another and a closed unit of cap element (5, 5') and base element (6, 6') are provided.

7. The device (1) according to claim 6, characterized in that the cap element (5, 5') on its rim portion (9) has a profile (10) for facilitating rotation of the cap element (5, 5').

8. The device (1) according to claim 6, characterized in that on the rim, portion (9) of the cap element (5, 5') an outwardly profiled, grip-enhancing and ergonomically shaped ring element (6) is positioned in a non-rotatable fashion for improved handling of the device and for facilitating rotation of the cap element (5, 5').

9. The device (1) according to claim the characterized in that the rim portion (39') of the base element (6, 6') has a sealing ring (42) on its outer side, wherein the sealing ring is in contact with the rim portion (9) of the cap element and, in this way, a sealed unit comprised of cap element (5') and base element (6') is provided.

10. The device (1) according to claim 9, characterized in that the sealing ring (42) is arranged in a circumferential groove in the outer side of the rim portion of the base element.

11. The device (1) according to claim 9, characterized in that the sealing ring is comprised of rubber, a foam-like plastic material, or felt.

12. The device (1) according to claim 1, characterized in that the cap element (5, 5') is detachably connected to the base element (6, 6').

13. The device (1) according to claim 1, characterized in that the base element (6, 6') comprises a peg (13, 13') axially symmetrically projecting from the first flat structure (12, 12') and provided with a bore (18) and the cap element (5, 5') has a pin (16), which can be inserted into the bore (18) of the peg (13, 13') and the cap element (5, 5') is connected rotatably by a securing ring (15) with the base element (6, 6').

14. The device (1) according to claim 13, characterized in that the peg (13, 13') has a polygonal cross-section and the hub element (23, 23') has a matching and precisely fitted bore (19) which makes it possible to place the hub element (23, 23') axially symmetrically and non-rotatably onto the peg (13, 13').

15. The device (1) according to claim 13, characterized in that the peg (13, 13') has a square cross-section and the hub element (23, 23') has a matching and precisely fitted square base (19).

16. The device (1) according to claim 1, characterized in that the staggered teeth (14, 14') form two tooth rings which are rotated relative to one another so as to be positioned an the gaps.

17. The device (1) according to claim 16, characterized in that the teeth (14, 14') have an average slant angle of greater than 35° and the tooth flanks (20) thus facing outwardly have a slant angle of 90°.

18. The device (1) according to claim 16, characterized in that the two tooth rings rotated relative to one another so as to be positioned on the gaps each have 4 teeth.

19. The device (1) according to one of the claims 16 to 13, is characterized in that two teeth (14, 14') each of a tooth ring are positioned perpendicularly to one another and one tooth each of a tooth ring is positioned parallel to a tooth of the respective other tooth ring end is displaced parallel by a gap width w relative to it.

20. The device (1) according to claim 1, characterized in that the underside (26) of the hub element (23, 23'), when it is placed onto the peg (13, 13'), is completely in contact with the first flat structure (12, 12').

21. The device (1) according to claim 1, characterized in that the hub element (23, 23') has a height h such that, when it is placed onto the peg (13, 13'), it projects past a rim portion (39, 39') of the base element (6, 6') and, when the base element (6, 6') with the hub element (23, 23') placed thereon is mounted on the cap element (5, 5'), the hub element (23, 23') projects into the axial-symmetrical, annular depression (27, 27') in the second flat structure (7) without contacting the second flat structure (7).

22. The device according to claim 1 or 8, characterized in that the base element (6, 6') and the cap element (5, 5') and/or the ring element (8) has markings for facilitating the introduction of the end portions (4) of at least one ribbon (3) through the pairs of cooperating openings (11, 17) of the base element (6, 6') and of the cap element (5, 5').

23. The device (1) according to claim 1, characterized in that the first flat structure (12, 12') of the base element (6, 6') has knobs (29) at its outer side which prevent a slipping of the base element (6, 6') relative to the shoe (2) or the piece of clothing.

24. The (1) device according to claim 1, characterized in that at the outer side of the first flat structure (12, 12') of the base element (6, 6') a bead-shaped outwardly overlapping ring element (43) is arranged, wherein the ring element (43) has a cutout in the area of the openings (17).

25. The device (1) according to claim 24, characterized in that the ring element (43) is comprised of soft material that does not slip on textiles.

26. The device (1) according to claim 1, characterized in that the hub element (23') at the underside (26') has peg-shaped projections (41) and the first flat structure (12') of the base element (6') comprises recesses (44) corresponding to the peg-shaped projections (41), wherein the peg-shaped projections (41) engage the recesses (44) and the hub element (23') is thereby non-moveably connected with the base element (6').

27. The device (1) according to claim 26, characterized in that the hub element (23') has a radial-symmetrical bore and is arranged with precise fit on the radial-symmetrical peg (13') projecting from the first flat structure (12').

28. The device (1) according to claim 1, characterized in that the flanks of the teeth (14') forming the tapering groove (25') have a circular arc shape wherein the circular radius increases continuously toward the interior of the groove.

29. The device (1) according to claim 1, characterized in that the device comprises furthermore a lid element (40) with channels (45) for receiving the end or tips (47) of the ribbon, wherein the channels (45) penetrating the lid element (40) receive the ribbon portions projecting from the openings (11).

30. The device (1) according to claim 29, characterized in that the underside of the lid element (40) is in areal contact with the outer side of the second flat structure (7) and does not cover the openings (11).

31. The device (1) according to claim 30, characterized in that the lid element (40) comprises additionally pegs (46) which engage corresponding recesses in the other side of the second flat structure (7') and thus prevent rotation of the lid element (40) relative to the cap element (5').

32. The device (1) according to one of the claims 29 or 30, characterized in that on the outer side of the cap element (5') a rim element (8') is fixedly arranged wherein the rim element (8') has an axial-symmetrical recess at the outer side of the second flat structure (7') for a precisely fitted receiving of the lid element (40) and a substantially continuous transition between the outer surface of the rim element (8') and the lid element (40) results.

33. The device (1) according to claim 32, characterized in that the rim element (8') is comprised of soft material, as, for example, soft plastic material.

* * * * *